US005622411A

United States Patent [19]

Weihrauch

[11] Patent Number: 5,622,411

[45] Date of Patent: Apr. 22, 1997

[54] PROCESS FOR JOINING BRISTLE BUNDLES TO A PLASTIC BRISTLE CARRIER AND APPARATUS FOR THE SAME

[75] Inventor: Georg Weihrauch, Wald-Michelbach/Odw, Germany

[73] Assignee: Coronet-Werke Heinrich Schlerf GmbH, Wald-Michelbach/Odw, Germany

[21] Appl. No.: 748,016

[22] Filed: Aug. 21, 1991

[30] Foreign Application Priority Data

Aug. 28, 1990 [DE] Germany ..... 40 27 108.0

[51] Int. Cl.[6] ..... A46D 3/04

[52] U.S. Cl. ..... 300/21; 264/243; 425/805

[58] Field of Search ..... 300/21; 425/112, 425/517, 805, 383; 264/243, 248, 249, 257, 258, 271.1, 273, 274, 261, 263, 267

[56] References Cited

U.S. PATENT DOCUMENTS

| | | | |
|---|---|---|---|
| 3,408,112 | 10/1968 | Piotrowski | 300/21 |
| 4,609,228 | 9/1986 | Bickel | 300/21 X |
| 4,633,559 | 1/1987 | Loren | 264/249 X |
| 4,637,660 | 1/1987 | Weihrauch | 300/21 |
| 4,936,633 | 6/1990 | Weihrauch | 300/21 |
| 4,988,146 | 1/1991 | Weihrauch | 300/21 |

FOREIGN PATENT DOCUMENTS

| | | | |
|---|---|---|---|
| 2903399 | 7/1980 | Germany | 300/21 |
| 278315 | 4/1928 | United Kingdom | 300/21 |

*Primary Examiner*—Frances Han

*Attorney, Agent, or Firm*—Antonelli, Terry, Stout & Kraus, LLP

[57] ABSTRACT

A process for joining bristle bundles to a plastic bristle carrier, wherein the bristles of each bundle are melted at their fastening-side ends, accompanied by the formation of a thickened portion. The bristle carrier is provided at the bristle reception side with holes for receiving the thickened portions. The bristle bundles with the thickened portions are pressed into the bristle carrier, with a space above a bristle receiving side and between the bristle bundles, annularly surrounding the bristle area, being sealed against the bristle carrier, and with material rising during pressing on pressure application and filling the sealed area being displaced and compressed.

18 Claims, 4 Drawing Sheets

FIG. 8a
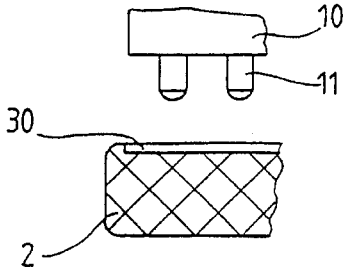
FIG. 8b
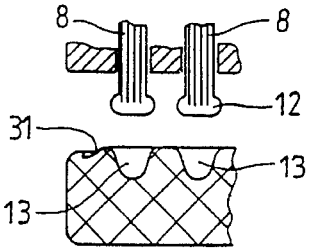
FIG. 8c
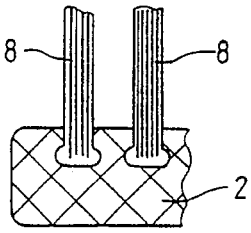
FIG. 9a
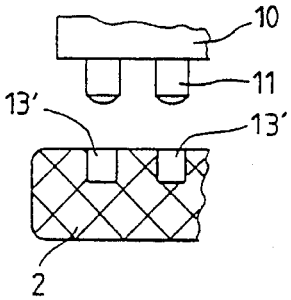
FIG. 9b
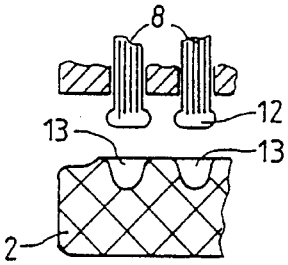
FIG. 9c
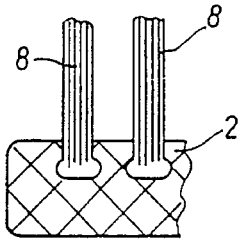
FIG. 10a
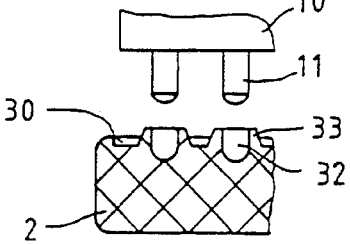
FIG. 10b
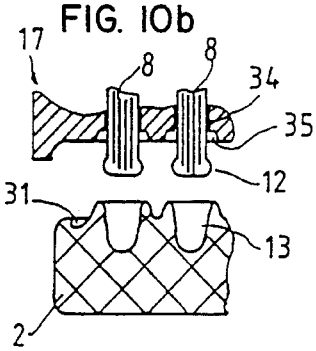
FIG. 10c
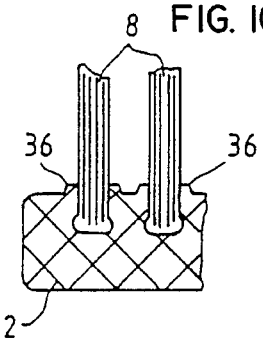
FIG. 11a
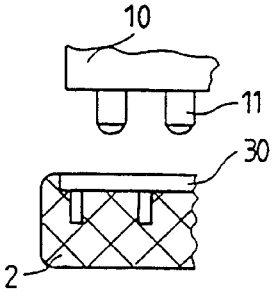
FIG. 11b
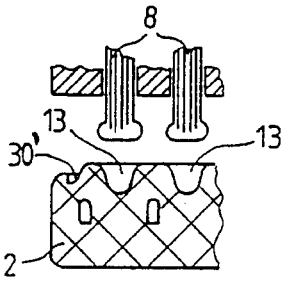
FIG. 11c
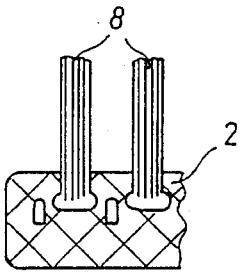
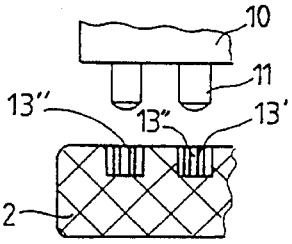
FIG. 12a
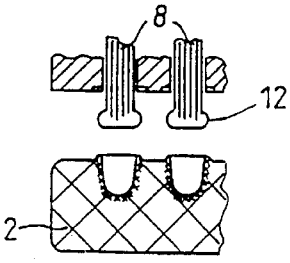
FIG. 12b
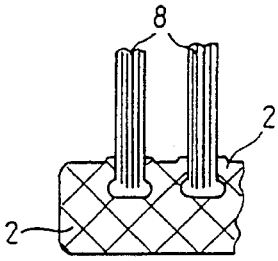
FIG. 12c

PROCESS FOR JOINING BRISTLE BUNDLES TO A PLASTIC BRISTLE CARRIER AND APPARATUS FOR THE SAME

FIELD OF THE INVENTION

The invention relates to a process for joining bristle bundles to a plastic bristle carrier, wherein the bristles of each bundle are melted at their fastening-side ends, accompanied by the formation of a thickened portion, with the bristle carrier being provided at the bristle reception side with holes for receiving the thickened portions and/or is melted at least in the areas receiving the thickened portions, and with the bristle bundles with the thickened portions being pressed into the holes or into the melted areas of the bristle carrier, accompanied by thermoforming and then the material rising during pressing is aftershaped.

BACKGROUND OF THE INVENTION

For joining bristle bundles to bristle carriers, both of which are made from plastic, numerous processes are known. In conjunction with the present invention only those processes are involved in which the bristle bundle is provided with a thickened portion, inserted in prepared holes on the bristle carrier and connected thereto by the melting or thermoforming of one of the two parts to be joined and the fixed connection is obtained during the solidification or hardening of the melt or the molecular reorientation of the thermoformed area.

In connection with the known welding (e.g. DD-A-221 633), which generally presupposes the same plastic for the bristles and bristle carrier, the ends of the bundles are melted and joined together by the coalescing of the melts. In the same manner the bristle carrier is melted in a locally defined manner, namely, at the joining points, and subsequently the bristle bundles and bristle carrier are brought together. Under pressure the melts flow together and form a welded joint. It has been recognized that as a result of the melting processes, on hardening, an irregular surface would be obtained on the bristle carrier. It has therefore been proposed to smooth the rising melt by shaping and optionally also providing a depression at the weld into which can be displaced the rising melt. However, this only leads to a partial surface smoothing. It is not possible to obtain a complete smooth, flat surface, because in order to obtain an adequate melting temperature in the outer regions there is necessarily a greater heat accumulation in the central region of the bristle carrier, i.e. the molten material and the melt viscosity increases from the inside to the outside. In the case of equidirectional reworking at the weld of the individual bundles it is consequently impossible to obtain the same working result over the entire surface.

The joining of bristles and bristle carriers made from the same or different plastic materials in the molten state constitutes a type of thermal joining process. It is known (EP-A-149 996), to melt the bristle ends to form a thickened portion and with the latter still in the plastics state to shape the bristle bundles into preshaped holes on the bristle carrier. The plastic thickened portion is intended to fill the holes provided with undercuts. The irregularities on the surface due to the rising melt are inter alia to be eliminated in that the holes are initially formed without undercuts, the thickened portions are introduced into the holes and subsequently the surrounding material is shaped on to the thickened portions. For this purpose the bristle carrier is provided in the vicinity of the holes with ring-like projections, which are then shaped by plasticizing the bristle carrier material, In this case the flatness or unevenness of the bristle carrier surface is once again significantly dependent on the behavior of the melt in the holes.

With the knowledge of the disadvantages of the aforementioned process, it has been proposed (DE-A-36 37 750) to only melt the holes preshaped in the bristle carrier in the vicinity of the hole bottom and to introduce the bristle bundle, whose ends are not melted together in this case, being introduced into the hole and into the melt located at its bottom. The melt is then intended to rise in the hole and between the bristles, so as to ensure an adequate anchoring thereof. The melt volume with respect to the still free volume in the hole is selected in such a manner that the melt does not rise to the outside of the bristle carrier. Naturally this is only wishful thinking, because an adequately precise heat transfer from the heating element to the walls in the vicinity of the hole bottom For forming an always constant melting mass cannot be achieved. The bristles are substantially only non-positively or frictionally held, so that there is no extraction-resistant anchoring of the same in the bristle carrier.

In the aforementioned process (DE-A-34 03 341) the bristles within the bundle are melted with one another at the fastening-side end to form a thickened portion and the latter, preferably in the hardened state, is pressed into the locally, e.g. in the form of holes, melted bristle carrier until the melt off the latter has flowed together again behind the thickened portion due to molecular reorientation. However, it is not possible to avoid the rising of the melt and the formation of a melt bead, which subsequently has to be levelled by a smoothing or aftershaping tool or formed into a precisely defined projection. For the reasons given hereinbefore (DD-A-221 633) this process is also not completely satisfactory.

SUMMARY OF THE INVENTION

The aim of the invention is to improve the aforementioned process in such a way that, while ensuring a firm binding off the bristle bundles into the bristle carrier, a completely satisfactory, flat surface is obtained on the bristle carrier.

ACCORDING TO THE PRESENT INVENTION

The space above the bristle reception side and between the bristle bundles and which surrounds in circular manner the bristle area formed by the same is sealed against the bristle carrier and that the material rising on pressing in the bristle bundles is displaced and compressed using pressure and fills the sealed space.

In the case of the inventive process the space immediately above the bristle carrier between the bristle bundles on and the bristle carrier outside the bristle area is sealed and the material rising between the inserted bristle bundles, e.g. the melt in the case of molten working or the thermoelastically displaced material in the case of thermoforming, is displaced and at the same time compressed in the defined space. Thus, it is possible to obtain over the entire bristle area a planar surface on the bristle carrier and by the additional compression to improve the hold of the bristle bundles in the bristle carrier.

In order to obtain a uniform good surface quality independently of the particular material displaced, preferably the space is marginally or peripherally elastically sealed. The fact that the pressure displacing and sealing the rising material is elastically applied serves the same function.

The sealing of the bristle area and the displacement of the rising material, accompanied by a simultaneous compression, can take place immediately following the joining process and the still existing plasticity or thermoelasticity can be utilized For the forming or shaping process. For equalizing the viscosity of the melt over the pressurized surface or for the at least partial, remelting in the case of a time delay between the joining process and the shaping process the circularly sealed space is supplied heat at a temperature below the melting point of the plastics material of the bristles, so that their stability does not suffer, while a completely satisfactory displacement and levelling of the rising melt is ensured.

According to a further development of the invention, the bristle carrier is provided on the bristle reception side with a depression extending over the entire bristle area and into it is displaced the rising material when applying the pressure.

The depression provided on the bristle reception side and extending over the entire bristle area and which can, in part, also be interrupted by projections or protuberances, e.g. in the vicinity of the bristle bundles, is able to receive a larger melt quantity without leading to a contour change on the bristle carrier surface. The size of the depression (surface area and depth) can be adapted to the specific use, e.g. the size or extension of the melt pool or pools, the thickness or displaced melt volume, etc.

According to a further development of the inventive process, the bristle carrier is provided on the bristle reception side with projections surrounding the holes or part of the holes with the projections being melted to at least a certain depth and displaced together with the rising material into the circularly sealed space outside the projections.

In this process variant on the bristle reception side cross-sectionally and height-defined humps are provided, which are entirely or partly levelled out during the subsequent compression process.

According to a further process variant, the bristle carriers are provided with individual small depressions besides the holes receiving the bundles and which are used on pressing in the bristle bundles and displacing the rising material as deforming displacement spaces.

In this case, free displacement spaces are formed by the additional depressions and the material displaced during the flattening and compression can escape into the depressions. The depressions can be constructed in the form of small diameter holes, which are closed and shaped and, in particular, reduced size during the thermal shaping in of the holes for the bundles and/or flattening the rising melt.

For minimizing the melt material necessary for embedding, the holes in the bristle carrier receiving the bundles can be provided with a profile, which can e.g. be constituted by webs, ribs, etc. and which is flattened on melting the hole walls. This also offers the possibility by melting the profile and the surface-near hole wall, not only to minimize the melt material, but also to fix it in a reproducible manner. The ribs and webs should be constructed in thin-walled form, so that they melt and collapse even when a limited amount of heat is supplied, without melting the surrounding bristle carrier material.

While the aforementioned process measures contribute to minimizing the melt material and lead to an equalization of the rising melt on joining, practical tests have shown that, in particular, for the size of the rising melt material and for the uniformity of the melt volume rising in following joining processes, not only the joining process and the thermal conditions when melting are important, but also the nature of the supply of the bristle bundles to the bristle carrier. Normally, the bristle bundles are guided in channels, which are arranged in an aligned manner in stratified guide plates. Between the guide plates or by means of one of the guide plates the bristle bundles, following the supply, are secured by displacing the channels relative to one another and melted at the ends projecting over the guide plates. Practice has shown that despite identical geometrical conditions the extent of the rising melt differs. It has now been found that this undesired effect can be eliminated or at least minimized if each bristle bundle is individually fixed by fluid pressure or spring tension.

The reason for the irregularities in melt formation would inter alia appear to be that in the known fixing process in which all the bristle bundles are subject to the action of a single fixing or clamping plate, different clamping forces occur on the individual bristle bundles, so that individual bundles during the joining process can escape or fall back more than others. The reason is the different bundle cross-sections and the different bristle packing within the bundle due to the necessarily present diameter tolerances in connection with the bristle monofilaments. With the inventively provided individual clamping of each bristle bundle by fluid pressure or spring tension, it is ensured that independently of the cross-section and bristle packing, each bristle bundle has the same clamping force applied thereto, so that no bristle bundle or individual bristles within a bundle can escape rearwards. Thus, the projecting length of bristles over the guide plate when melting the bristle ends is always the same and during the joining process it is also ensured that, due to the lack of any possibility of falling back, the bristle bundles are introduced with the same pressure or identical insertion depth into the melt on the bristle carrier. Thus, the rising melt during the joining process is minimized and made uniform during succeeding joining processes.

According to another process variant, the aforementioned negative effect can also be largely eliminated in that the bristle bundles are secured according to the rope friction principle between the spaced guide plates under the action of a plate-parallel clamping force acting in the gap.

As opposed to normal clamping between plates resting on one another with different friction conditions between the clamping plate and the bristle bundles and the individual bristles within a bundle, as a result of the inventive deflection of the bristle bundle in accordance with the rope friction principle, it is possible to apply a clamping force such that the frictional forces between the bristles of a bundle prevent any falling back or escape of individual bristles.

For the performance of the process, the invention is based on a known apparatus (e.g. EP 0 149 996), which has a receptacle for the bristle carrier, at least two parallel guide plates spaced from the receptacle and having aligned channels for the supply of the bristle bundles, at least one clamping device fixing the bristle bundles in the channels at least during the joining to the bristle carrier and at least one heating device melting the bristle ends projecting beyond the channels and the bristle means on the bristle reception side.

According to the invention such a known apparatus, is characterized in that the guide plate facing the receptacle or a platen positioned upstream thereof has a sealing zone circularly surrounding the bristle area and which cooperates with a corresponding circular sealing zone on the bristle carrier or on its receptacle during the moving together of the guide plate or platen and the receptacle.

In the case of the inventively constructed apparatus, the sealing zone comes into action on moving together the bristle carrier receptacle and the guide plate or platen and forms a sealed space above the bristle side surrounding the bristle area and into which is displaced the melt rising during the joining process on further moving together.

There are numerous possibilities for forming the sealing zone. Thus, the circular sealing zone can be formed by a groove and a rib engaging in the latter, one being provided on the guide plate or platen and the other on the bristle carrier or its receptacle. Instead of this, the circular sealing zone can be formed by interengaging steps on the guide plate or platen and on the bristle carrier or its receptacle. The circular sealing zone can also be formed by an elastic ring or the sealing zone can have such an elastic ring associated with it.

Particularly in the case of a differing infeed path for the platen and the bristle carrier receptacle, the two aforementioned embodiments ensure a completely satisfactory sealing and a space-filling displacement of the melt.

In another development, in the space sealed between the guide plate or platen and the bristle carrier is placed an elastic material layer with channels for the bristle bundles, which rests on the bristle carrier and elastically deforms on applying pressure.

In the aforementioned construction sealing can once again take place by a step or the like, while the shaping pressure during the displacement of the melt always remains the same even when there is a different melt volume due to the elasticity of the pressure surface or the available space is automatically adapted to the volume of the material to be displaced.

Finally, the guide plate or platen can be heated, in order to ensure a constant viscosity in the area to be shaped.

According to another development of the inventive apparatus, at least one of the guide plates has a cavity or between two adjacent guide plates a cavity is formed and that channels traversing the cavity are provided for guiding the bristle bundles, whose walls, under the action of a fluid pressure are entirely or partly shapable against the bristle bundles in the cavity.

As a result of this construction of the apparatus for each individual bristle bundle a constant clamping force is used as a result of the hydrostatic conditions in the cavity and which can be adjusted in such a way that any falling back of the bristle bundle in the guide channel or individual bristles within the bundle can be reliably avoided.

In another embodiment, the same action is achieved in that the wall of each guide channel has a recess, in which engages a spring-loaded clamping member acting against the bristle bundle.

Finally, the apparatus can be constructed in such a manner that two adjacent guide plates are spaced and between them and spaced from them can be slid or moved, in plate-parallel manner, a clamping plate with bores for the bristle bundles, with the spacing of the clamping plate from the two guide plates and the displacement path being chosen in such a manner that an angle is obtained between the individual bristles of the bundle.

Thus, in this embodiment, the bristle bundles are displaced into the gap between the spaced guide plates, accompanied by a deflection. The extent of the deflection is chosen in such a manner that the bundles or the bristles of an individual bundle cannot escape or fall back.

Finally, it is advantageous if the clamping body or clamping plate is rounded in edge-free manner on its surface acting on the bristle bundle.

BRIEF DESCRIPTION OF THE DRAWINGS

The invention is described in greater detail hereinafter relative to non-limitative embodiments and the attached drawings, wherein:

FIGS. 8*a*–8*c* are schematic views of the process sequence in another variation of the present invention;

FIGS. 9*a*–9*c* are schematic views of a further process variation in accordance with the present invention;

FIGS. 10*a*–10*c* are schematic views of a variation of the process sequence of FIG. 8;

FIGS. 11*a*–11*c* are schematic views of a process variation with additional displacement spaces;

FIGS. 12*a*–12*c* are schematic views of a process variation with melting material minimization;

DETAILED DESCRIPTION

Figure 1A:
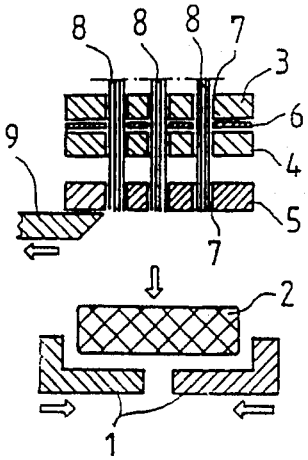
FIGS. 1*a*–1*f* are schematic views of a portion of an apparatus according to the present invention in different process stages.
Figure 1B:
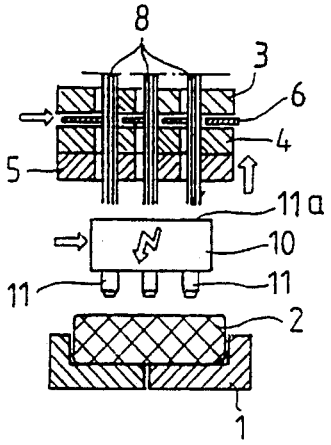
Figure 1C:
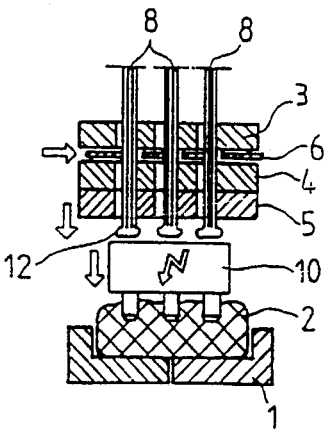

The apparatus according to FIGS. 1*a*–1*f* has a two-part receptacle 1 for a bristle carrier 2, which is e.g. produced by injection moulding and which is fixed in the receptacle 1. Parallel-stratified guide plates 3, 4 and 5 are spaced from the receptacle 1. A clamping plate 6 is located between the guide plates 3 and 4. The guide plates 3, 4 and 5 have aligned channel 7 for supplying bristle bundles 8.

The apparatus also has a cutting mechanism 9 (FIGS. 1*a* and 1*e*) and a heating element 10 (FIGS. 1*b* and 1*c*) which can be introduced between the bristle carrier receptacle 1 and the guide plates 3, 4 and 5. The apparatus operates in the following manner.

The bristle bundles 8 are unwound from a reel, e.g. in the form of a continuous strand. The bristle carrier 2 is fixed in the receptacle 1, e.g. by clamping. The bristle bundles 8 are introduced in the form of so-called short cuts or in continuous strands from reels into the channel 7 of the guide plates 3, 4 and 5, which initially directly rest on one another. The guide plate 5 is then moved to just before the free ends of the bristle bundle 8. In this position it serves as a cutting face for the cutting mechanism 9, which cuts to the same final length the projecting ends of the bristle bundle 8.

Figure 1D:
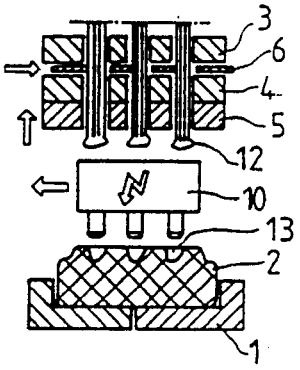
Figure 1E:
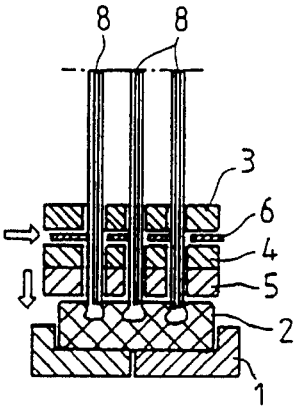

The guide plate 5 then moves back, so that the bristle bundles 8 are exposed at their ends. The heating element 10 is then moved between the bristle ends and the bristle carrier 2. In the indicated embodiment, the heating element 10 has, on the side facing the bristle reception side of the bristle carrier 2, heated pins 11 and on the other side a heating reflector 11*a*. By a corresponding moving together of the guide plates 3 to 5 and the receptacle 1 the heated pins 11 move into the bristle reception side of the bristle carrier 2 and form depressions and at the same time the exposed ends of the bristle bundle 8 are melted so that thickened portions 12 (FIGS. 1*c*, 1*d*) are formed there. Subsequently, the guide plates 3 to 5 and the receptacle 1 are again moved apart, as shown in FIG. 1*d* and the heating element 10 is extended. Subsequently, the entire unit is brought together again, as shown in FIG. 1*e*. The bristle bundles 8 with their thickened portion 12 penetrate the melted depressions 13 of the bristle carrier 2. In the process stages according to FIGS. 1*b* to 1*e* the clamping plate 6 has been moved against guide plates 3, 4 in the direction arrow, so that the bundles are fixed in the channels 7.

Figure 1F:
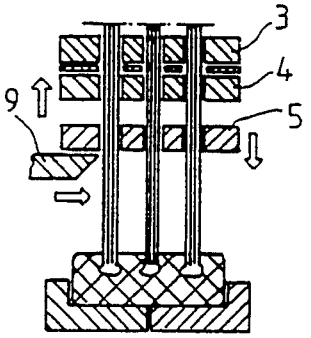

Following the joining process shown in FIG. 1*e*, the melt of the bristle carrier 2 flows the behind the thickened portions on the bristle bundles 8. When an adequate tearing-out resistance has been achieved following the hardening or the melt, the guide plates 3 to 5 are raised again, as shown in FIG. 1*f*. The lower guide plate 5 runs into an advanced position and, subsequently, the bristle bundles are cut to length by the cutting mechanism 9 at their use-side ends.

Figure 3:
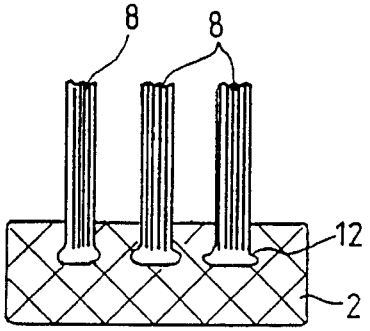
FIG. 3 is a cross-sectional view corresponding to FIG. 2 in an idealized form.
Figure 2:
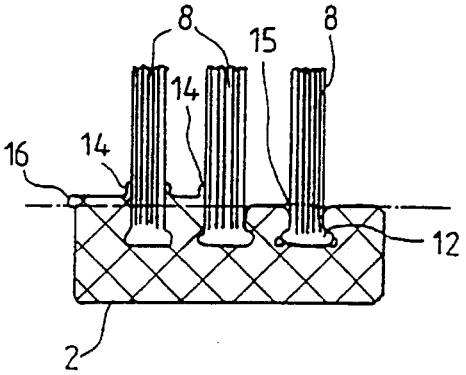
FIG. 2 is a schematic cross section through a brush in the construction as actually obtained.

A brush produced according to the above process is diagrammatically schematically shown in FIG. 2, Generally more or less significant irregularities are formed in the vicinity or the melted portions of the bristle carrier 2. Thus, e.g. due to rising melt, burrs 14 can form above the bristle carrier surface and in the vicinity or the bristle bundles 8. It is also possible in the vicinity of the bristle bundle fastening point for craters 15 and in the hole bottom bubbles to form (right-handle bundle in FIG. 2) and finally there is a risk of a general deformation or the bristle carrier 2 at the bristle reception side, as indicated at 16. These irregularities are not only undesired for optical reasons, but also for use and hygienic reasons. FIG. 3 shows an ideal construction, which is the aim or the present invention.

Figure 4A:
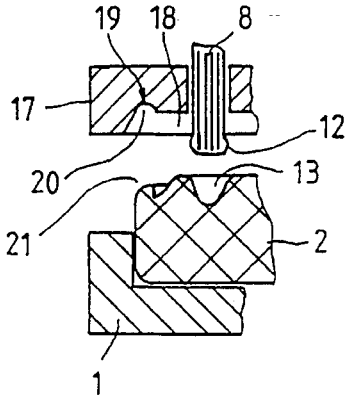
FIGS. 4*a*–4*c* are detail views of the apparatus in different process stages with sealing of the melt zone.
Figure 4B:
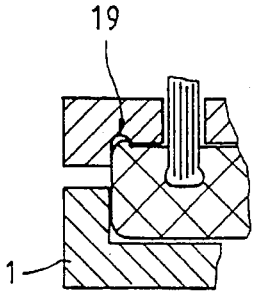
Figure 4C:
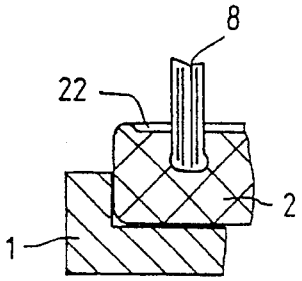

FIGS. 4*a*–4*c*, 5*a*–5*c*, 6*a*–6*c* and 7*a*–7*c* illustrate a first process measure for removing the irregularities described in connection with FIG. 2, In the embodiment of FIGS. 4*a*–4*c* upstream of or instead of the guide plate 5 is provided a platen 17, below which is formed a space 18 with a sealing zone 19 circularly surrounding the bristle area. During the joining process, when the thickened portions 12 of the bristle bundles 8 penetrate the depressions 13 of the bristle carrier 2, the platen 17 also moves downwards, so that the space 18 above the bristle reception side of the bristle carrier 2 is completely sealed, in that the sealing zone 19 cooperates with the bristle carrier 2. In the embodiment of FIGS. 4*a*–4*c* the sealing zone is formed by a groove 20 in the platen 17 and a web-like projection 21 on the bristle reception side of the bristle carrier 2. In the moved together stage shown in FIG. 4*b*, the space in the circular sealing zone 19 located above the bristle reception side is sealed with respect to the outside. As a result the melt displaced by the platen is uniformly distributed and simultaneously compressed within the space. FIG. 4*c* shows the final process product where, due to the shaping process on the bristle reception side of the bristle carrier 2 is formed a flat depression 22 with a planar surface.

Figure 5A:
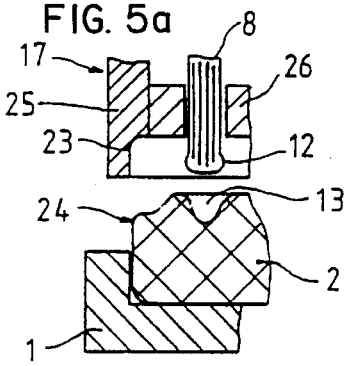
FIGS. 5*a*–5*c* are detail views of a modification of the apparatus of FIGS. 4*a*–4*c;*
Figure 5B:
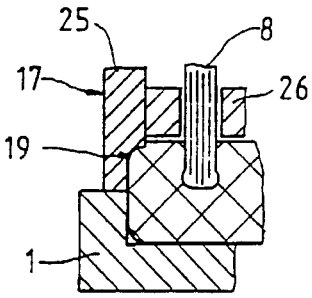
Figure 5C:
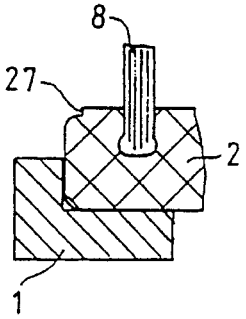

In the embodiment according to FIGS. 5*a*–5*c* the sealing zone 19 (FIG. 5*b*) is formed by a step 23 on the platen 17 and the outer contour of the bristle carrier 2 which also acts as a step 24. In this case the bristle reception side is raised somewhat with respect to the peripheral contour of the bristle carrier 2. The platen 17 is constructed in two parts, in that it comprises an outer frame part 25 and a plate 26 movable with respect thereto from the starting position of FIG. 5*a*, the platen 17 is moved downwardly until the frame part 25 seals with its step 23 on the bristle carrier step 24. The plate 26, which may be under an elastic force, stays back on moving together and simultaneously compensates and compresses the melt, which is distributed up to the sealing step 23. On the bristle reception side of the bristle carrier of the finished product according to FIG. 5*c* is formed a low, scarcely perceptible and in particular non-disadvantageous step 27.

Figure 6A:
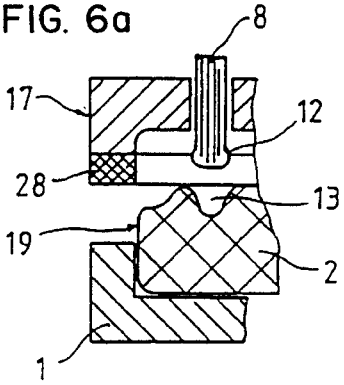
FIGS. 6*a*–6*c* are detail views of a third embodiment of the present invention.
Figure 6B:
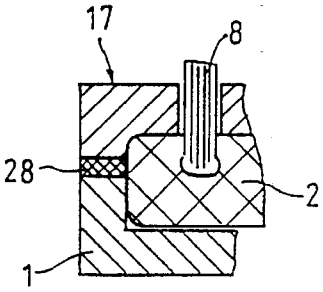
Figure 6C:
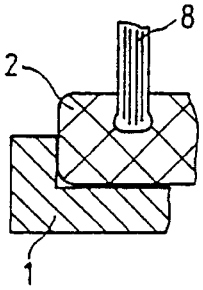

In the embodiment according to FIGS. 6*a*–6*c* the bristle carrier 2 has a similar construction to the embodiment of FIGS. 5*a*–5*c*. However, differing from the latter, the platen 17 is provided with an elastic sealing ring 28, which cooperates with the receptacle 1 of the bristle carrier 2. The Sealing zone 19 is once again formed by a gap seal, as in FIGS. 5*a*–5*c*. On moving together the receptacle 1 and the platen 17, the seal 28 ensures a compensating pressure distribution on melt displacement at the bristle reception side of the bristle carrier 2. The resulting product can be seen in FIG. 6*c* and has a completely smooth surface on the bristle reception side of the bristle carrier 2.

Figure 7A:
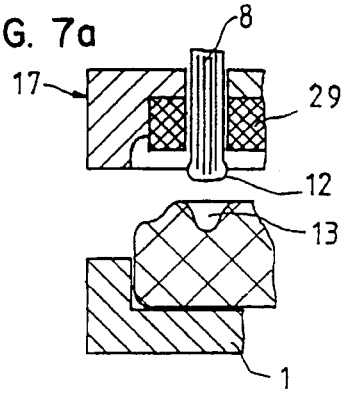
FIGS. 7*a*–7*c* are detail views of a further modified embodiment of the present invention.
Figure 7B:
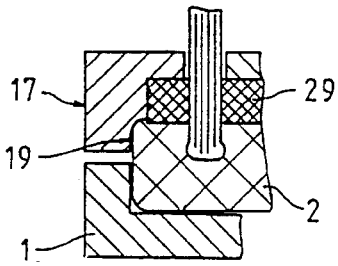
Figure 7C:
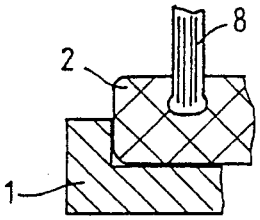

In the embodiment of FIGS. 7*a*–7*c*, the face of the platen 17 is essentially formed by an elastic material layer 29 which, on moving together the receptacle 1 and the platen 17, as shown in FIG. 7*b*, can be compressed. Once again the sealing zone 19 is formed by steps or by a gap seal. The elastic material layer 29 ensures a uniform pressure distribution at the bristle reception side of the bristle carrier 2.

FIGS. 8*a*–8*c*, 9*a*–9*c* and 10*a*–10*c* show further process variants for producing a brush with the idealized form shown in FIG. 3. In the case of the embodiment of FIGS. 8*a*–8*c* the bristle carrier 2 is provided with a depression 30 extending over its entire bristle area end into which are shaped the holes 13 by means of the heated pins 11 of the heating element 10. The upwardly rising melt reduces the depth of the depression 30 in zonal manner. During the subsequent equalization in one of the process variants of FIGS. 4*a*–4*c*, 5*a*–5*c*, 6*a*–6*c* and 7*a*–7*c*, the melt escaping upwards and sideways is displaced into the remaining sinks 31 of the depression 30, so that once again a smooth surface is obtained on the bristle receptacle side, as shown in FIG. 8*c*.

FIGS. 9*a*–9*c* depict an embodiment in which the bristle carrier 2 has prefabricated holes 13' (FIG. 9*a*), which are only melted on the hole wall and shaped into the holes 13 (FIG. 9*b*)). As a result the melt material is minimized and equalized in the aforementioned manner (FIG. 9*c*).

In the embodiment according to FIGS. 10*a*–10*c*, on the bristle reception side of the bristle carrier 2, there is once again a depression 30 extending over the entire bristle area. Unlike in the embodiment of the bristle carrier according to FIGS. 8*a*–8*c*, the latter has preshaped holes 32 with a collar 33 projecting over the bottom of the depression 30. After melting the holes 32 according to FIG. 9*a* and melting the bristle ends to formerly thickened portion 12, deeper holes 13 are formed on The bristle carrier 2 and the geometrically regular collars 33 are given an irregular shape. In this embodiment the platen 17 is provided with a depression 35 in the vicinity of each channel 34 of a bristle bundle 8. On moving together the bristle receptacle and the platen 17, the melt is once again displaced and compressed in the remaining sinks 31 of the depression 30. The end product according to FIG. 9*c* has, in the vicinity of each bristle bundle 8, uniformly contoured, collar-like projections 36.

In the embodiment according to FIGS. 11*a*–11*c*, with each bristle bundle 8 or its associated hole 13 (FIG. 11*b*)) are associated, together with the depression 30 extending over the entire bristle area, smaller depressions 30', which extend deeper into the bristle carrier 2 than the bundles in the fixed state. These small depressions 30' are closed and simultaneously reduced in size on shaping in the holes 13 (FIG. 11*b*). During the subsequent insertion of the bristle bundles and compressing, the rising melt further plasticly deformable material can be displaced into the depressions (FIG. 11*c*).

In the embodiment according to FIGS. 12*a*–12*c* the melt material is minimized in that the bristle carrier 2 has prefabricated holes 13' with inwardly projecting ribs 13" and, in the illustrated embodiment, there are four projecting ribs 13" arranged in diametrical manner. Only these ribs 13" and the surface-near near hole wall are melted so that, as shown in FIG. 12*b*, on melting and joining in the bundles 8 only a little melt material is displaced upwards. The subsequent compression can optionally take place in such a way that on the surface of the bristle carrier each bristle bundle 8 is surrounded by a narrow collar.

Figure 13A:
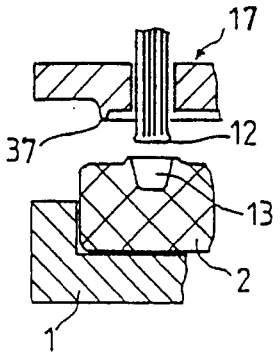
FIGS. 13*a*–13*c* are schematic views of the process sequence in an optimized combination of two process variants in accordance with the present invention.
Figure 13B:
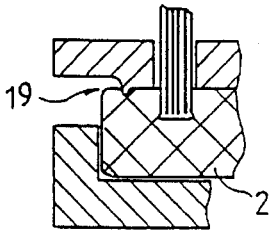
Figure 13C:
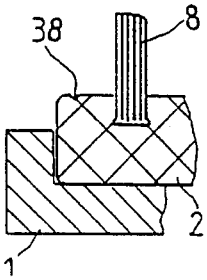
Figure 14:
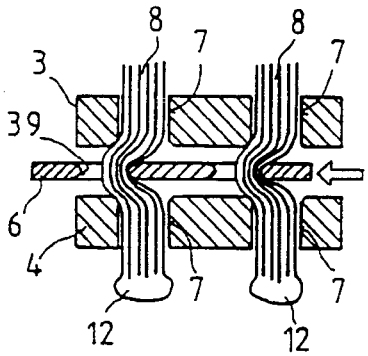
FIG. 14 is a schematic cross-sectional view of an embodiment for bundle clamping.

FIGS. 13*a*–13*c* depict a further variant for the sealing zone 19. After melting on the bristle side 3 and the formation of the holes 13, the bristle carrier 2 has an irregular surface as a result of the bristle carrier melt rising. In this embodiment, the platen 17 is provided with a web 37 passing circularly around the bristle area and which on moving together the receptacle 1 and the platen 17 penetrates the bristle carrier 2 and consequently forms the sealing zone 19, as shown in FIG. 13*b*. The product produced in this way and shown in FIG. 13*c* is provided on the bristle reception side of the bristle carrier 2 with a limited depth groove 38 passing circularly round the bristle area and which does not impair the product either from the use, or the hygienic standpoint.

FIGS. 14, 15*a*–15*b*, 16*a*–16*b* and 17*a*–17*b* depict process variants for the clearly defined clamping of the bristle bundle 8. In the embodiment according to FIG. 14 the guide plates 3, 4 with the channel 7 for guiding the bundles 8 are given a greater spacing from one another, at least in the clamping positions. Between the guide plates 3, 4 and spaced therefrom, the clamping plate 6 is transversely displaceable and its bores 39 are very rounded. As a result of the transverse movement of the clamping plate 6 the bristle bundles 8 are greatly deflected to the side between the guide plates 3, 4, so that the bundles 8 are fixed in a uniform, reproducible manner in the clamped position. The friction conditions between the individual bristles of a bundle are such that they cannot escape during the joining process.

Figure 15A:
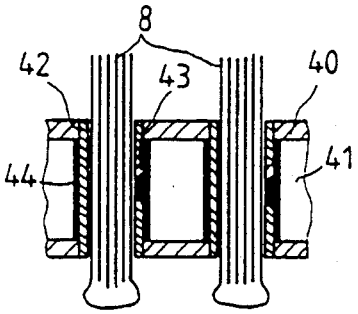
FIGS. 15*a*–15*b* are schematic cross-sectional views of another bundle clamping embodiment according to the present invention.
Figure 15B:
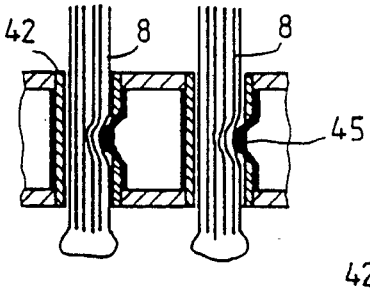

FIGS. 15*a* and 15*b* depict a modified construction, where there is a guide plate 40, which has a cavity 41, which is traversed by sleeves 42 and which in turn form the channels for the bristle bundles 8. The sleeves 42 have at least one recess 43 and are surrounded by an elastic tube 44. The cavity 41 can be hydraulically or pneumatically subject to pressure action, so that the tube is deformed in the recess 43 of the sleeves 42, as shown in FIG. 15*b*. As a result of the fluid pressure and the tube portion 45 penetrating the recess of the sleeve 42, the bristle bundle 8 is secured within the sleeve 42. Independently of fluctuations in the external diameter of the bundle 8 or the bristle group, a constant clamping force is ensured for each bristle bundle.

Figure 16A:
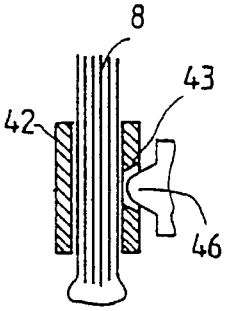
FIGS. 16*a*–16*b* are schematic cross-sectional views of a further modification of a bundle clamping arrangement of FIGS. 15*a*–15*b*.
Figure 16B:
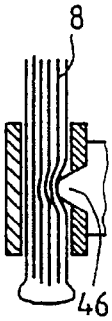

According to FIGS. 16*a* and 16*b*, the embodiment of FIGS. 15*a* and 15*b* can be given a purely mechanical construction, in that the sleeve 42 once again has a recess 43, but within the guide plate clamping members 46 are provided, which are e.g. movable by spring tension from the position of FIG. 16*a* into the clamped position of FIG. 16*b*. Naturally, instead of this, a fluid can also act on said clamping members 46 in the case of a corresponding guidance and sealing.

Figure 17A:
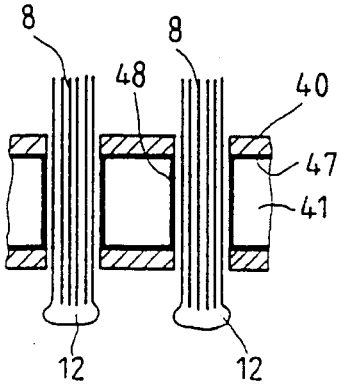
FIGS. 17*a*–17*b* are schematic cross-sectional views of yet another modified bundle clamping embodiment.
Figure 17B:
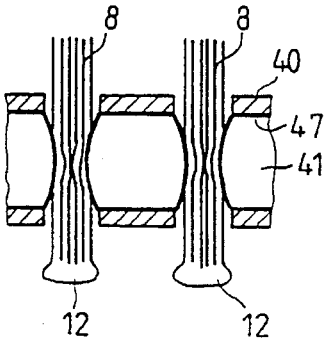

In the embodiment according to FIGS. 17*a* and 17*b* the guide plate 40 again has a cavity 41, as in the embodiment according to FIGS. 15*a* and 15*b*. However, in place of the sleeves 43, the cavity 4t contains a multichamber-like membrane 47, which has passages 48 corresponding to the channel 7 in guide plates 3, 4 and 5 in the previously described embodiments and through which the bristle bundles 8 are supplied. The membrane 47 is subject to the action of a pressurized fluid, so that its wall curves out in the vicinity of the passages 48, as shown in FIG. 17*b*. As a result of the hydrostatic pressure conditions within the membrane 47, the same clamping force again acts on each bristle bundle 8.

I claim:

1. A process for joining bristle bundles to a plastic bristle carrier, the process comprising the steps of melting bristles of each bundle at fastening-side ends thereof so as to form a thickened portion at the fastening side ends of the bristle bundles, pressing the bristle bundles with the thickened portions into holes provided in a bristle receiving area of the bristle carrier accompanied by thermal forming, sealing a periphery of the bristle receiving area and between the bristle bundles, pressing and displacing rising material due to the pressing of the bristle bundles so as to compress the rising material in the sealed periphery of the bristle area so as to obtain a planar surface over the bristle receiving area.

2. A process according to claim 1, wherein the bristle receiving area is supplied with heat at a temperature above a melting point of the bristles.

3. A process according to claim 1, further comprising the step of providing the bristle carrier on a bristle receiving side with a depression extending over the bristle receiving area for accommodating the rising material displaced during the step of pressing and displacing.

4. A process according to claim 1, further comprising the step of providing the bristle carrier with individual depressions adjacent the holes receiving the bristle bundles, wherein during the step of pressing the bristle bundles and the step of pressing and displacing of the rising material, said depressions serve as spaces for receiving the rising material.

5. A process according to claim 1, further comprising the step of profiling the holes receiving the bundles in the bristle carrier with a profile which is melted during the pressing and displacing rising material.

6. A process according to claim 1, further comprising the step of individually clamping each bristle bundle by one of fluid pressure or spring tension during formation of the thickened portion at the fastening side ends of the bristle bundles.

7. A process according to claim 1, further comprising the step of clamping the bristle bundles between spaced guide plates during the formation of the thickened portion of the fastening side ends of the bristle bundles.

8. An apparatus for joining bristle bundles to a bristle carrier, the apparatus comprising a receptacle for accommodating the bristle carrier, at least two guide plates spaced from the receptacle and disposed in parallel to one another and to said receptacle, each of said guide plates having aligned channels for guiding the bristle bundles, at least one clamping device for fixing the bristle bundles in the channels at least during a connection of the bristle bundles to the bristle carrier, at least one heating mechanism for melting zones of bristle ends projecting out of the channel, and a platen positioned upstream of the receptacle, said platen including a sealing zone peripherally surrounding a bristle receiving area of the bristle carrier and cooperable with a corresponding peripheral sealing zone on the bristle carrier for peripherally sealing the peripheral sealing zone while accommodating rising material during a compression of the bristle carrier and the bristle bundles during the connection of the bristle bundles to the bristle carrier, whereby the peripheral sealing zone on the bristle carrier comprises a substantially planar surface.

9. An apparatus according to claim 8, wherein the peripheral sealing zone of the platen cooperates with one of a groove and a projection extending from the receiving area of the bristle carrier, and another of said groove and projection is provided on the bristle receiving area of the bristle carrier.

10. An apparatus according to claim 8, wherein the peripheral sealing zone is formed by engaging steps on the platen and on the bristle carrier.

11. An apparatus according to claim 8, wherein means are provided for heating the platen.

12. An apparatus according to claim 8 wherein at least on one of the guide plates includes a cavity, and wherein the channels traverse the cavity, said channels being at least partially deformable against the bristle bundles by a fluid pressure acting on the cavity.

13. An apparatus according to claim 12, wherein a wall of each of said channels includes a recess engageable by a spring-loaded clamping body acting against the bristle bundles.

14. An apparatus according to claim 13, wherein the clamping body has a rounded edge on a surface thereof acting on the bristle bundles.

15. An apparatus according to claim 8, wherein the clamping device includes a displaceable clamping plate arranged between the guide plates, said clamping plate including bores for accommodating the bristle bundles, and wherein a spacing between the clamping plate and two guide plates is such that displacement of the displaceable clamping plate results in an application of a frictional force between individual bristles of the bristle bundles.

16. An apparatus according to claim 15, wherein the clamping plate has a rounded edge on a surface thereof acting on the bristle bundles.

17. An apparatus for joining bristle bundles to a bristle carrier, the apparatus comprising a receptacle for accommodating the bristle carrier, at least two guide plates spaced from the receptacle and disposed in parallel to one another and to said receptacle, each of said guide plates having aligned channels for guiding the bristle bundles, at least one clamping device for fixing the bristle bundles in the channels at least during a connection of the bristle bundles to the bristle carrier, at least one heating mechanism for melting zones of bristle ends projecting out of the channel and a platen positioned upstream of the receptacle, said platen including a sealing zone peripherally surrounding a bristle receiving area of the bristle carrier and cooperable with a corresponding peripheral sealing zone on the bristle carrier for peripherally sealing the peripheral sealing zone while accommodating rising material during a compression of the bristle carrier and the bristle bundles during the connection of the bristle bundles to the bristle carrier, whereby the peripheral sealing zone on the bristle carrier comprises a substantially planar surface, and wherein a ring is formed for peripherally sealing the peripheral sealing zone while accommodating the rising material.

18. An apparatus for joining bristle bundles to a bristle carrier, the apparatus comprising a receptacle for accommodating the bristle carrier, at least two guide plates spaced from the receptacle and disposed in parallel to one another and to said receptacle, each of said guide plates having aligned channels for guiding the bristle bundles, at least one clamping device for fixing the bristle bundles in the channels at least during a connection of the bristle bundles to the bristle carrier, at least one heating mechanism for melting zones of bristle ends projecting out of the channel and a platen positioned upstream of the receptacle, said platen including a sealing zone peripherally surrounding a bristle receiving area of the bristle carrier and cooperable with a corresponding peripheral sealing zone on the bristle carrier for peripherally sealing the peripheral sealing zone while accommodating rising material during a compression of the bristle carrier and the bristle bundles during the connection of the bristle bundles to the bristle carrier, whereby the peripheral sealing zone on the bristle carrier comprises a substantially planar surface, and wherein an elastic material layer provided with channels for accommodating the bristle bundles rests on the bristle carrier, said elastic material layer being elastically deformed during the compression of the bristle carrier and the bristle bundles.

* * * * *